United States Patent [19]

Distel et al.

[11] Patent Number: 4,622,811

[45] Date of Patent: Nov. 18, 1986

[54] BURNER AND METHOD FOR REMOVAL OF ACCUMULATED SOOT ON A SOOT FILTER IN INTERNAL COMBUSTION ENGINES

[75] Inventors: Robert Distel; Hans Gröner, both of Munich; Peter Kugland, Schweitenkirchen, all of Fed. Rep. of Germany

[73] Assignee: Bayerische Motoren Werke AG, Fed. Rep. of Germany

[21] Appl. No.: 725,659

[22] Filed: Apr. 22, 1985

Related U.S. Application Data

[63] Continuation of Ser. No. 498,691, May 27, 1983, abandoned.

[30] Foreign Application Priority Data

May 27, 1982 [DE] Fed. Rep. of Germany ..... 3219948

[51] Int. Cl.[4] ..... F01N 3/10

[52] U.S. Cl. ..... 60/303; 55/96; 55/DIG. 30; 55/DIG. 10; 431/172; 431/173; 431/242; 431/258

[58] Field of Search ..... 431/171–173, 431/242, 243, 263, 258, 351, 352, 9; 55/466, 523, DIG. 30, DIG. 10, 96; 60/303; 11/11

[56] References Cited

U.S. PATENT DOCUMENTS

| | | | |
|---|---|---|---|
| 3,190,071 | 6/1965 | Negre | 431/243 |
| 3,352,345 | 11/1967 | McLendon | 431/352 |
| 3,758,261 | 9/1973 | Galliano | 431/173 |
| 3,951,584 | 12/1983 | Thekdi | 431/173 |
| 4,419,113 | 12/1983 | Smith | 55/DIG. 30 |

OTHER PUBLICATIONS

Diesel Particulate Trap Regeneration Techniques-Soc. of Auto. Engr. Paper 810118; Feb., 1981; by W. R. Wade, J. E. White and J. J. Florek.

*Primary Examiner*—Carroll B. Dority, Jr.
*Attorney, Agent, or Firm*—Craig & Burns

[57] ABSTRACT

A burner for cleaning accumulated soot from a soot filter associated with the exhaust of internal combustion engines, the burner is simple from a constructional viewpoint and especially effective with respect to initiation and maintenance of a soot-burning process in the soot filter. The burner includes a fuel nozzle, air nozzle, and glow plug arranged in a predetermined succession in the flow direction of the air introduced into the burner chamber. An especially intensive intermingling of the fuel-air mixture for the burner and/or for the soot filter is obtained by producing a turbulent flow by means of the air nozzle.

10 Claims, 4 Drawing Figures

BURNER AND METHOD FOR REMOVAL OF ACCUMULATED SOOT ON A SOOT FILTER IN INTERNAL COMBUSTION ENGINES

This is a continuation of application Ser. No. 498,691, filed May 27, 1983, now abandoned.

BACKGROUND OF THE INVENTION

The invention relates to a burner for a soot filter associated with internal combustion engines. The burner includes a fuel nozzle, a glow plug or spark plug, and an air nozzle through which secondary air is introduced into a burner chamber located between the internal combustion engine and the soot filter.

A burner for a soot filter is illustrated schematically in the SAE Paper 81 01 18. It would be difficult to find more detailed data regarding the background and construction thereof than the one set forth in this piece of literature. Generally, burners of this type provide, especially in a diesel engine, regeneration of the soot filter while continuously maintaining the filtering function. The power capacity of the burner must meet high requirements, particularly for this usage. The fuel-air mixture delivered by the burner needs to be fed to the soot filter simultaneously with the exhaust gases from the internal combustion engine and a burn-off process of the soot accumulated on the filter should be capable of being initiated by this mixture in any circumstance, i.e. even in case of cold or especially hot exhaust gases. This process to be effective, is to be maintained over a definite time period. Normally, burn-off should continue until the soot has been at least almost completely burnt off. An important consideration is that the temperature of the soot filter, by this burn-off process, is not to exceed a predetermiend value, in order to prevent destruction of the filter.

SUMMARY OF THE INVENTION

The invention is based on the object of providing a constructionally simple design of the burner, making it possible to conduct a controlled burn-off of the soot accumulated on the soot filter.

The invention attains this object by arranging, in the burner chamber, as seen in the flow direction of the air, the air nozzle, the fuel nozzle, and the glow or spark plug.

By the series connection of the three essential parts of the burner, it becomes possible to initiate a soot burn-off process and maintain the same in a controlled fashion over a predetermined time period, independently of the counterpressure of the soot filter produced by the later due to the collected quantity of soot and the exhaust gas rate of the internal combustion engine, and in spite of a generally stationary exhaust gas flow.

Initiation of the burn-off process takes place, for example, in the case where diesel is the fuel introduced into the burner chamber, by first activating the glow plug. After reaching a sufficiently high glow plug temperature, a small amount of air is added. Subsequently, a short-term fuel injection takes place via the fuel nozzle which thereby greatly increases the burner chamber temperature. Thereafter, the amount of air fed into the burner chamber is greatly increased, and additional fuel is injected. It should be understood that the burner may be installed in the exhaust system and that the exhaust gases would be the primary flow of air and that the injected air would be the secondary flow of air. It is, of course, in the burner, possible to feed fuel and air at the same time. Once activated, the temperature in the burner remains stable and heats the soot accumulated thereon filter to such an extent that the soot is burnt off.

Upon the burner, and thereby the soot filter, reaching a relatively high temperature, produced by the combustion of the fuel in the burner chamber, it is possible by turning the glow plug on and off in a predetermined manner to lower the burner and soot filter temperature and/or maintain the same at a constant value. During the time when the glow plug is on, the fuel nozzle and the air nozzle of the burner continue feeding a combustible mixture to the soot filter in order to maintain the soot burn-off process. Due to the high temperature of the burner chamber, atomization and heating of the fuel, with at least partial combustion thereof, may spontaneously take place in this chamber.

The controlled regeneration of the soot filter can be further improved by providing that the air nozzle has a tangential outlet orifice extending substantially in the peripheral direction of the burner chamber. In such a burner, the air nozzle generates turbulent flow, with the consequence that the fuel and/or its combustion products reaching the soot filter are finely distributed on account of the relatively long flow path and the turbulence. Such a burner can also be located in relatively close proximity to the soot filter and yet offers, under all usage conditions, assurance that the soot burn-off process is initiated and maintained in a controlled predetermined manner.

By means of another feature, the effectiveness of the burner at the beginning of a soot burning process can be improved. If a portion of the burner chamber is located at or below the outlet opening of the chamber, a portion of the fuel will collect in unburnt form in the burner chamber at the beginning of the fuel feed step. After initiation of the burn-off process and concomitantly with the increasing temperature of the burner chamber, this fuel is vaporized and leads to a temporary enrichment of the mixture fed to the soot filter. Thereby, in conjunction with the vapor-phase state of the fuel, it is ensured that a temperature of the soot filter optimal for the burn-off step is quickly attained.

Two additional improvements of the invention deal with the air feed. The first improvement resides in that the entire amount of air required for the burn-off step is introduced into the burner chamber by way of the air nozzle. This is in contrast to subdividing the air into a first portion introduced into the burner chamber and a second portion fed to the mixture exiting from the burner chamber. This feature provides an especially homogeneous mixture enhancing the controlled regulation of the soot burn-off process. The second additional improvement resides in that the burner chamber is surrounded by an annular chamber traversed by the air prior to reaching the air nozzle. The air cools the burner chamber and thus saves the same from a high, damaging temperature. At the same time, the air is preheated thereby which, in turn, has positive effects on the efficiency of the burner.

Finally, by matching the fuel introduced into the burner chamber to the fuel fed to the internal combustion engine, further reductions in the additional expenditure required for the burner is achieved. In the case of a diesel engine, diesel fuel is also fed to the burner and optionally heated with the aid of a glow plug or spark plug. In the case of a gasoline engine, gasoline fuel is utilized for conducting the burn-off process, in conjunction with a glow plug or spark plug. In either case, the fuel can be obtained from the fuel supply system of the internal combustion engine with the readily apparent advantage being that separate supply and/or fuel storage means for the burner can be eliminated.

Accordingly, it is an object of the present invention to provide a burner and a method of using the burner with a soot filter associated with an internal combustion engine which avoids, by simple means, shortcomings and disadvantages encountered in the prior art.

Another object of the present invention resides in providing a burner for use with a soot filter which is simple in construction and relatively inexpensive to manufacture.

Yet another object of the present invention resides in providing a method for cleaning a soot filter associated with an internal combustion engine which may be carried out in an economical and efficient manner.

A further object of the present invention resides in providing a burner for use with a soot filter which uses the same fuel supply as the internal combustion engine.

Yet a further object of the present invention resides in providing a burner for use with a soot filter which is capable of controlling the temperature of the cleaning action to thereby preclude damage to the soot filter.

These and other objects, features, and advantages of the present invention will become more apparent from the following description when taken in connection with the accompanying drawings which show, for purposes of illustraiton only, two embodiments of the invention, and wherein.

BRIEF DESCRIPTION OF THE PREFERRED EMBODIMENTS

Figure 1:
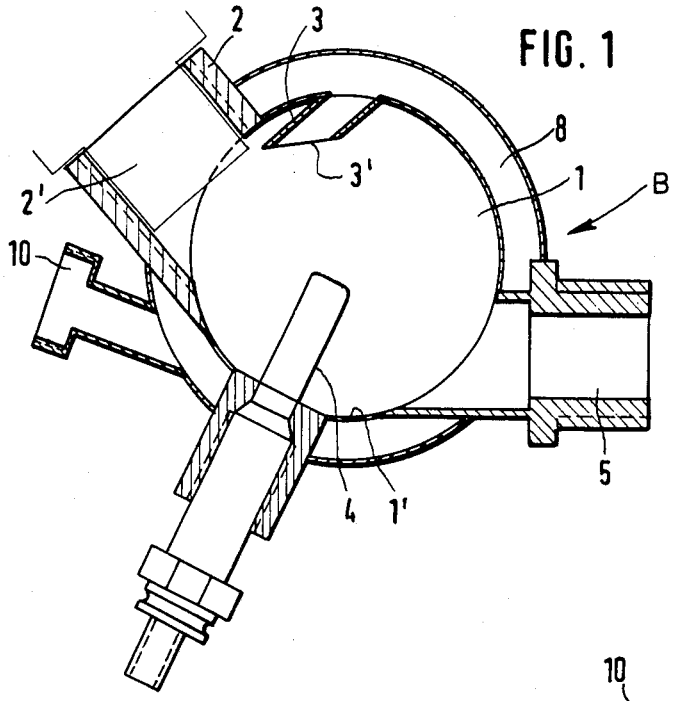
FIG. 1 shows a burner for a soot filter of a diesel engine.

Referring now to the drawings wherein like reference numerals are used throughout the several views to designate like parts and, more particularly, the burner B of FIG. 1 includes a generally spherical or cylindrical burner chamber 1. The burner includes a connection 2 for a fuel injection nozzle 2′ (not illustrated in great detail), a generally tangentially directed air nozzle 3 which terminates in the burner chamber 1 which includes an orifice 3′ to permit compressed air to be introduced into the chamber through the nozzle, and a glow plug 4 which projects into the burner chamber 1. Burner chamber 1 is connected via an outlet opening 5 to the exhaust gas manifold E and/or the housing of a soot filter F, not shown. The air nozzle 3, the fuel injection nozzle 2′, and the glow plug 4 are disposed one behind the other, as seen in the flow direction of the air.

The entire amount of air introduced via air nozzle 3 and utilized for initiating and maintaining a soot burning process in the soot filter mixes with the fuel supplied by the fuel injection nozzle 2′. This fuel air mixture is then conducted past the glow plug 4. At that location, the fuel is heated and/or ignited and passes, in the form of a heated fuel-air mixture and/or in the form of combustion products of such a mixture, to the soot filter. In the illustrated embodiment, diesel fuel is injected by nozzle 2′ to thus create an enriched air-fuel mixture which is then conducted past the glow plug 4 before passing to the soot filter.

On account of the turbulence produced in the burner chamber 1, the air-fuel mixture is homogeneous with the fuel being finely distributed due to the tangential disposition of the nozzle 3 causing a swirling and turbulent flow of air introduced into the chamber. It is thereby possible to effect a controlled initiation and conductance of the burn-off process while maintaining the function of the soot filter. An additional feature of the illustrated structure of the burner includes a portion 1′ of the burner chamber arranged underneath of or at the same level with the outlet opening 5. The effect of this portion 1′ is that, at the beginning of the fuel feed via the fuel injection nozzle 2′, fuel will be at least partially precipitated on the bottom of the burner chamber 1 and will be vaporized upon heating of the chamber. This fuel, which when reaching the soot filter, is heated and or ignited directly or additionally by the glow plug 4, makes it possible, especially at the beginning of the soot burn-off step, to quickly reach the operating temperature which is optimal for this process of burning off the accumulated soot on a soot filter.

Figure 3:
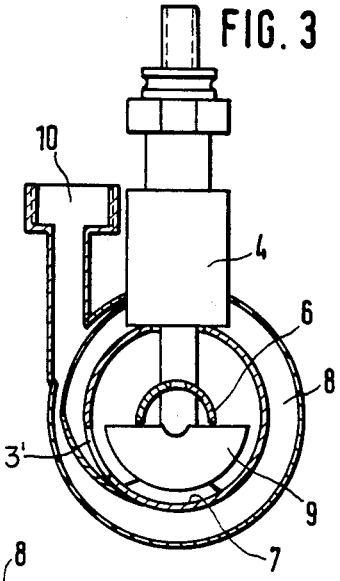
FIG. 3 shows a section taken along line III—III in FIG. 2.
Figure 2:
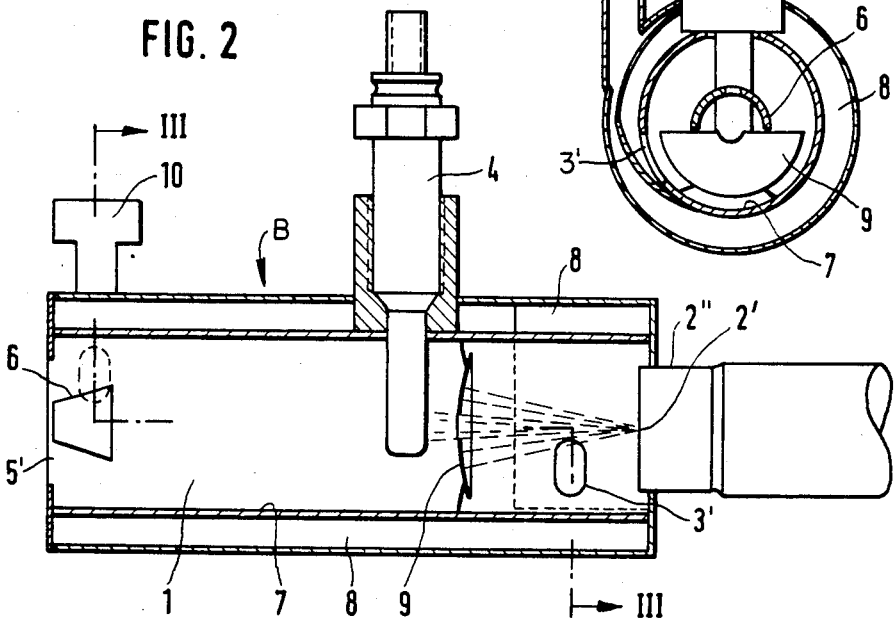
FIG. 2 shows another embodiment of the burner of FIG. 1.

The alternative burner, shown in FIGS. 2 and 3, wherein parts having the same function carry reference numerals identical to those in FIG. 1, is generally cylindrical in shape with injection of fuel occurring at one end. The cylindrical burner chamber 1 contains on one of its ends a connection 2 for a fuel nozzle 2″. Air is supplied via a tangential orifice 3′ oriented in the peripheral direction of the burner chamber 1. Air introduced via this orifice 3′ produces a generally swirling and turbulent air flow which efficiently mixes with the fuel supplied by the injection nozzle 2′. This fuel-air mixture then travels past the glow plug 4 where it is heated and/or ignited with the swirled and mixed resultant exiting the chamber through outlet opening 5′ and continuing on to the soot filter where the soot burn-off process is accomplished.

Here, too, part of the burner chamber 1 is located even with or below the outlet opening 5′ and is seen in this embodiment in the form of a trough 7. The effect of this trough 7 corresponds to that of portion 1′ in FIG. 1. Additionally, a flame holder 6 is shown in the zone of the outlet opening 5′ for providing a controlled ignition of the mixture leaving the burner chamber 1. Additionally, a shield 9 for the fuel jet emanating from the injection nozzle 2′ is arranged in front of the glow plug 4. Thus the shield 9, in cooperation with the peripherally positioned air orifice 3′, provides a controlled fuel feed, wherein the fuel and air is mixed in a turbulent manner prior to following past the glow plug 4 and the function of the latter is ensured precisely at the start of operation of the burner.

As illustrated in both embodiments, the air is conducted, prior to reaching the air orifice 3′, in an annular chamber 8 which almost entirely surrounds the combustion chamber 1. The air is introduced into the annular chamber 8 by way of a connection 10. Due to this special arrangement of annual chamber 8, air introduced into the burner chamber 1 has, on the one hand, cooled and saved the burner chamber 1 from thermal damage, and on the other hand, the burner chamber 1 has been preheated and thus can effect heating of the fuel-air mixture in the burner as a supplement or alternative to the glow plug 4.

Figure 4:
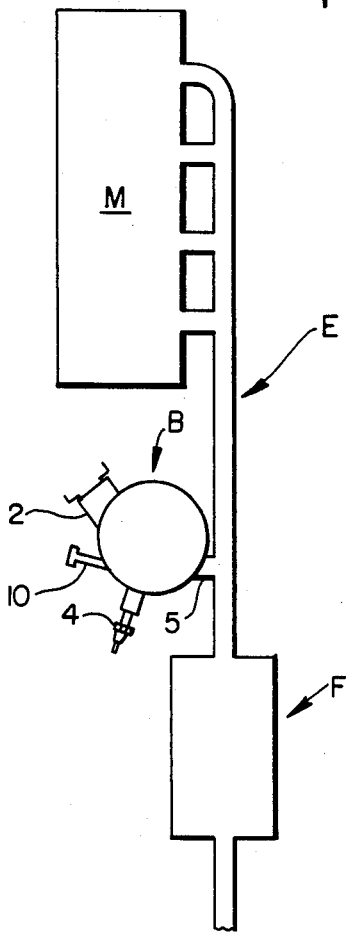
FIG. 4 is a schematic diagram showing an engine and a portion of an exhaust system for the engine, a burner according to the instant invention is shown relative to a soot filter in the portion of the exhaust system.

FIG. 4 shows a burner B in accordance with the instant invention disposed in a portion of the exhaust system for the engine M between the engine M and a soot filter F. It should be understood that the burner can also be connected directly to the soot filter.

As an alternative to the aforedescribed use of the burner for a continuously turned-on soot filter, it is, of course, also possible to utilize the same for a reversing soot filter which is turned off during regenerating. In this case, it is expedient to interrupt fuel feed after initiation of the burn-off step and to merely feed air to the soot filter.

While we have shown and described only two embodiments in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

What is claimed is:

1. A system for burning off accumulated soot on soot filters associated with internal combustion engines comprising an internal combustion engine having an exhaust system, a soot filter disposed in the exhaust system downstream from the engine, and a burner connected to the exhaust system between the engine and the soot filter, the burner including a burner chamber, an annular chamber disposed around said burner chamber, means for injecting fuel into the burner chamber including a fuel nozzle, plug means for one of inducing heat to and causing ignition of a fuel-air mixture in the burner chamber, and means for conducting air having traversed through the annular chamber into the burner chamber, said means for conducting air including a tangentially disposed outlet orifice for introducing the entire amount of air employed in the burner chamber and located in the periphery of the burner chamber for inducing a generally swirling flow to the air being introduced into said burner chamber, the air orifice, the means for injecting fuel, the plug means being flow arranged one behind the other in the burner chamber in the flow direction of the air through the burner chamber, said annular chamber being disposed around the burner chamber in a manner such that air passing therethrough cools the burner chamber and is preheated prior to being conducted into the burner chamber through the outlet orifice.

2. A system according to claim 1, wherein a portion of the burner chamber is disposed proximate the level of an outlet opening of the burner chamber.

3. A system according to claim 1 wherein fuel supplied by the fuel nozzle is the same type of fuel which is supplied to the internal combustion engine.

4. A system according to claim 1, wherein the burner chamber is substantially cylindrical and the annular chamber substantially surrounds the burner chamber.

5. A system according to claim 1, wherein the burner chamber is substantially cylindrical.

6. A system according to claim 8, wherein the fuel nozzle is at one end of the burner chamber and the outlet orifice disposed intermediate the fuel nozzle and the plug means.

7. A system according to claim 1, wherein a shield means is disposed between the fuel nozzle and the plug means for controlling the flow of the air fuel mixture past the plug means.

8. A system according to claim 1, wherein the plug means includes a glow plug.

9. A method of burning-off accumulated soot on a soot filter fed from an exhaust from an internal combustion engine, wherein a burner is connected to the exhaust intermediate the internal combustion engine and the soot filter, comprising the combined step of preheating of air to be introduced into a burner chamber and cooling of the burner chamber prior to the introduction of the air into the burner chamber by directing the air through an annular chamber surrounding the burner chamber and the steps of introducing the entire amount of air employed in the burner chamber in a radial flow of turbulent air from the annular chamber into the burner chamber of the burner through a tangentially disposed outlet orifice opening generally in the peripheral direction of the burner chamber, injecting fuel into the turbulent air down stream in the flow of the air, heating of the fuel-air mixture and conducting the heated mixture to the soot filter where the mixture reacts with the accumulated soot on the soot filter to burn the soot.

10. The method as set forth in claim 9, including the step of controlling the flow of the fuel and air mixture to a means for heating by the interposition of a shield between a means for injecting fuel and the means for heating.

* * * * *